US007702275B2

(12) United States Patent
Morishita

(10) Patent No.: US 7,702,275 B2
(45) Date of Patent: Apr. 20, 2010

(54) CLEANING DEVICE

(75) Inventor: Hiroki Morishita, Osaka (JP)

(73) Assignee: Kyocera Mita Corporation (JP)

( * ) Notice: Subject to any disclaimer, the term of this patent is extended or adjusted under 35 U.S.C. 154(b) by 396 days.

(21) Appl. No.: 11/900,814

(22) Filed: Sep. 13, 2007

(65) Prior Publication Data

US 2008/0175617 A1 Jul. 24, 2008

(30) Foreign Application Priority Data

Sep. 15, 2006 (JP) ..... 2006-250511

(51) Int. Cl.
*G03G 21/00* (2006.01)

(52) U.S. Cl. ..... 399/357

(58) Field of Classification Search ..... 399/107, 399/110, 111, 123, 343, 357, 358; 15/256.51
See application file for complete search history.

(56) References Cited

U.S. PATENT DOCUMENTS 6,704,540 B2 * 3/2004 Maeshima et al. ..... 399/357
6,928,252 B2 * 8/2005 Takami et al. ..... 399/111
2003/0185588 A1 10/2003 Takami et al.

FOREIGN PATENT DOCUMENTS

| | | |
|---|---|---|
| CN | 1448808 | 10/2003 |
| JP | 2000-112309 | 4/2000 |
| JP | 2005-77675 | 3/2005 |

* cited by examiner

*Primary Examiner*—Hoan H Tran
(74) *Attorney, Agent, or Firm*—Gerald E. Hespos; Michael J. Porco

(57) ABSTRACT

A cleaning device includes: a first shaft; a cleaning roller which is operable to come into contact with a surface of a photosensitive drum, and is integrally rotated with the first shaft; a pressing member for pressing the cleaning roller against the surface of the photosensitive drum; a second shaft; a spiral roller which is integrally rotated with the second shaft, and is operative to collect toner residues from the surface of the photosensitive drum; a driving force transmitting mechanism for transmitting a driving force of the photosensitive drum to the first shaft and the second shaft; and a pair of arm members which are pivotally interlocked with the second shaft, and are pivotally interlocked with the first shaft. The cleaning device allows for suppressing image jitter or noise resulting from jitter of the photosensitive drum.

5 Claims, 7 Drawing Sheets

CLEANING DEVICE

BACKGROUND OF THE INVENTION

1. Field of the Invention

The present invention relates to a cleaning device for use in an image forming apparatus such as an electrostatic copier, a laser printer, and a facsimile machine, and more particularly to a cleaning device for use in an image forming apparatus provided with an a-Si (amorphous silicon) photosensitive drum.

2. Description of the Related Art

There is known an mage forming apparatus e.g. a printer provided with an amorphous silicon photosensitive drum. Amorphous silicon to be used as a material for the amorphous silicon photosensitive drum has a relatively large hardness and a long useful life, but has a disadvantage that an electric charge is likely to leak during a long-term use. Accordingly, there is a likelihood that a toner image may be deteriorated in use of the amorphous silicon photosensitive drum. There is proposed a cleaning device equipped with a cleaning roller to prevent deterioration of a toner image. Specifically, the cleaning roller is constantly pressingly contacted against the surface of the photosensitive drum to thereby polish the surface of the photosensitive drum. The cleaning roller is made of a foaming synthetic rubber. A cleaning device with a cleaning roller is e.g. disclosed in Japanese Unexamined Patent Publication No. 2000-112309.

The cleaning device disclosed in the publication includes: a support shaft; a pair of arm members pivotally supported about the axis of the support shaft; a cleaning roller interlocked with an end of the arm member pair; a spring member for applying a load to the surface of an amorphous silicon photosensitive drum by way of the cleaning roller; a first gear integrally rotated with the photosensitive drum; and a second gear which is integrally rotated with the cleaning roller and in mesh with the first gear.

There is also known a cleaning device provided with a spiral roller for collecting toner particles. The cleaning device is advantageous in layout designing by engaging a gear of the spiral roller with a gear of a cleaning roller and by driving the spiral roller with use of the gear of the cleaning roller.

In the above arrangement, however, there is a likelihood that jitter of a photosensitive drum may cause image jitter or noise. In other words, in the arrangement of driving the spiral roller by the gear of the cleaning roller, the driving force of the cleaning roller may fluctuate, which may cause jitter of the photosensitive drum, thereby resulting in image jitter or noise.

SUMMARY OF THE INVENTION

In view of the above, an object of the invention is to provide a cleaning device which has solved the above problems residing in the prior art.

Another object of the invention is to provide a cleaning device that enables to suppress image jitter or noise resulting from jitter of a photosensitive drum.

A cleaning device according to an aspect of the invention includes: a first shaft; a cleaning roller which is operable to come into contact with a surface of a photosensitive drum, and is integrally rotated with the first shaft; a pressing member for pressing the cleaning roller against the surface of the photosensitive drum; a second shaft; a spiral roller which is integrally rotated with the second shaft, and is operative to collect toner residues from the surface of the photosensitive drum; a driving force transmitting mechanism for transmitting a driving force of the photosensitive drum to the first shaft and the second shaft; and a pair of arm members which are pivotally interlocked with the second shaft, and are pivotally interlocked with the first shaft.

These and other objects, features and advantages of the present invention will become more apparent upon reading the following detailed description along with the accompanying drawings.

DETAILED DESCRIPTION OF THE PREFERRED EMBODIMENTS

Figure 1:
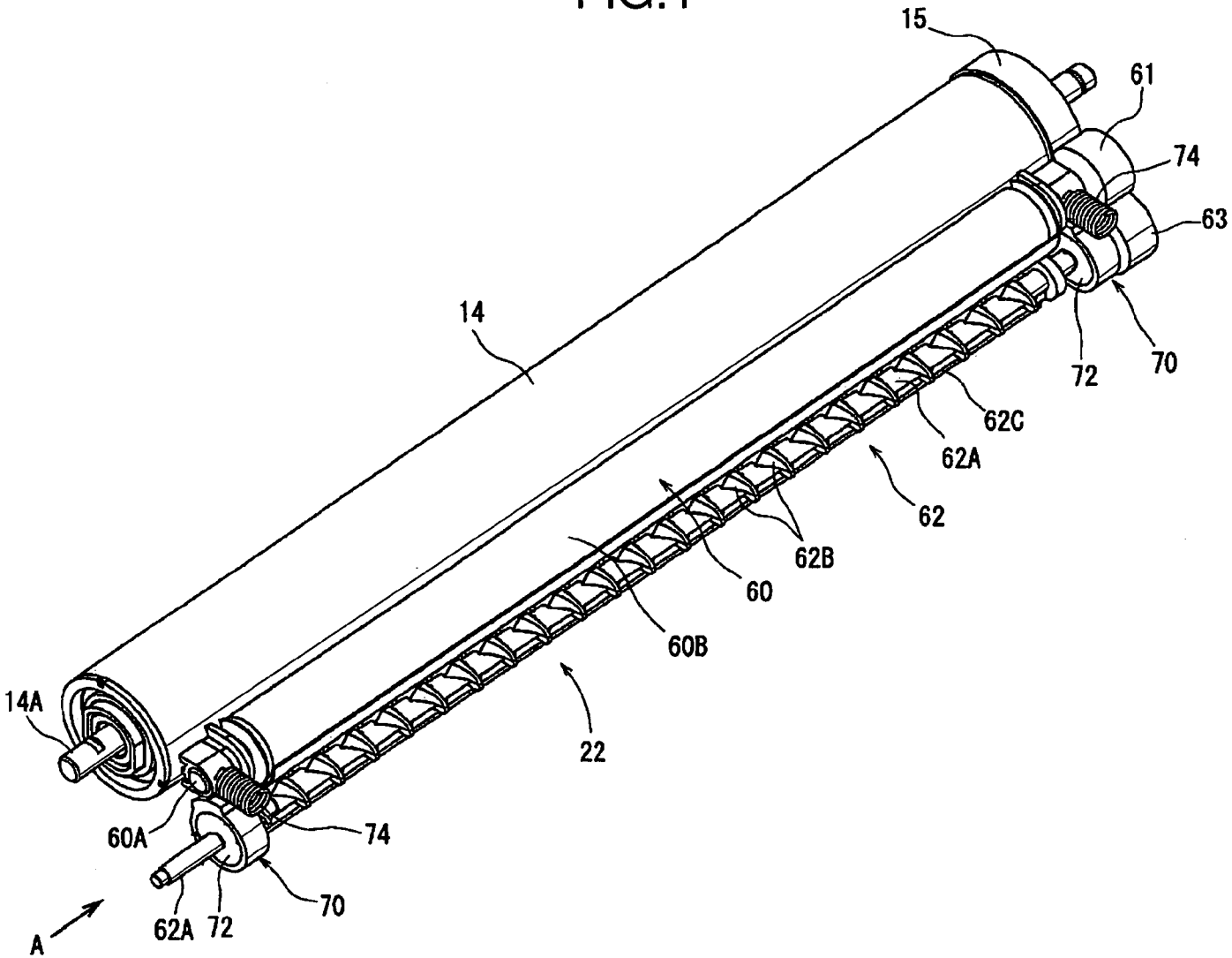
FIG. 1 is a perspective view of a cleaning device embodying the invention.

In the following, a cleaning device embodying the invention is described in detail referring to the drawings.

Before the cleaning device according to the embodiment is described, the entire construction of a tandem color printer (hereinafter, simply called as a "printer") 2, as an example of an image forming apparatus provided with the cleaning device, is described referring to FIG. 6.

The printer 2 has a main body 4 as a substantially rectangular parallelepiped image forming apparatus main body. A magenta processing unit 6M, a cyan processing unit 8C, a yellow processing unit 10Y, and a black processing unit 12BK are arranged in the printer main body 4. The processing units 6M, 8C, 10Y, and 12BK are arranged in this order from upstream in a sheet transport direction. Each of the processing units 6M, 8C, 10Y, and 12BK includes imaging elements such as a photosensitive drum 14, a charger 16, a developer 18, a primary transfer roller 20, and a cleaning device 22. An amorphous silicon photosensitive member is used as the photosensitive drum 14. In FIG. 6, the reference numerals concerning the processing units are attached merely to the imaging elements of the magenta processing unit 6M for simplifying the illustration. In this embodiment, the processing units GM, BC, 10Y, and 12BK are arranged side by side substantially in a horizontal direction in the aforementioned order substantially linearly from right to left in FIG. 6.

A laser scanning unit LSU is provided below the processing units GM, 8C, 10Y, and 12BK. The laser scanning unit LSU successively irradiates a laser beam for scanning onto the surfaces of the photosensitive drums 14 of the processing units GM, 8C, 10Y, and 12BK based on image information.

An intermediate transfer belt mechanism 24 is provided above the processing units GM, 8C, 10Y, and 12BK. The intermediate transfer belt mechanism 24 includes a drive roller 26, a driven roller 28, and an intermediate transfer belt 30 wound around the drive roller 26 and the driven roller 28. The intermediate transfer belt 30 extends substantially horizontally in transverse directions of FIG. 6 between the drive roller 26 and the driven roller 28.

Toner replenishing containers 18M, 18C, 18Y, and 18BK are mounted at positions above the intermediate transfer belt 30 in correspondence to the processing units GM, 8C, 10Y, and 12BK, respectively. Each of the toner replenishing containers 18M, 18C, 18Y, and 18BK is adapted to replenish toner of a corresponding color to the corresponding developer 18 via an unillustrated transport path and an unillustrated transporter.

In each of the processing units GM, 8C, 10Y, and 12BK, the primary transfer roller 20 is pressingly contacted with the photosensitive drums 14 from above by way of a lower running area of the intermediate transfer belt 30.

Figure 6:
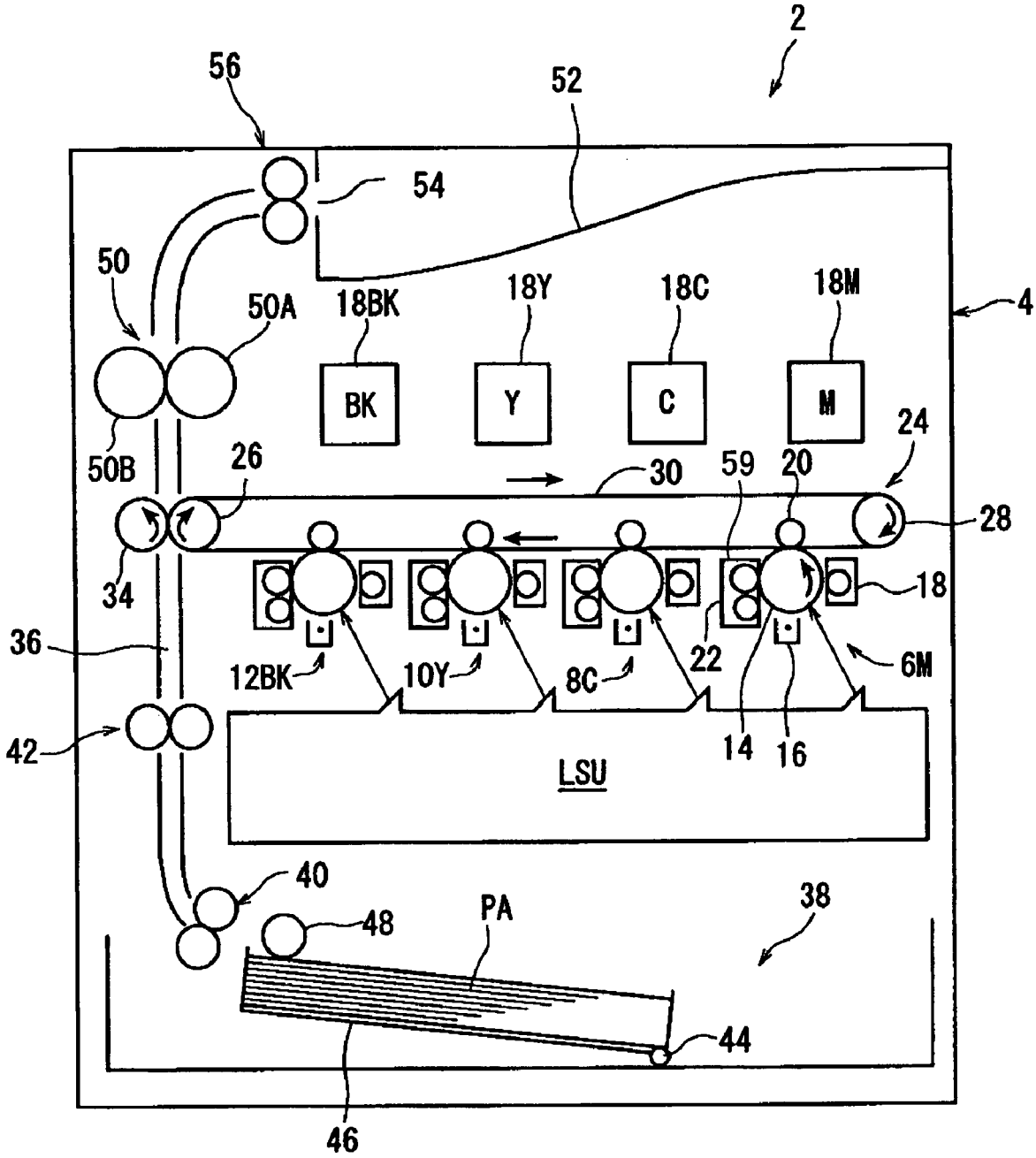
FIG. 6 is a schematic diagram of a tandem color printer to which the embodiment of the invention is applied.

A secondary transfer roller 34 is arranged on the left of the drive roller 26 in FIG. 6. The secondary transfer roller 34 is pressingly contacted with the drive roller 26 in a rightward direction in FIG. 6 via the intermediate transfer belt 30. The drive roller 26 is rotated clockwise in FIG. 6. Accordingly, the intermediate transfer belt 30, the primary transfer rollers 20, and the driven roller 28 are also rotated clockwise.

A transport path 36 is formed on a left side of the intermediate transfer belt mechanism 24 in FIG. 6 to transport a sheet PA as a recording medium. The transport path 36 extends substantially vertically along an inner left side wall of the printer main body 4 in FIG. 6. A nip portion between the drive roller 26 of the intermediate transfer belt mechanism 24, and the secondary transfer roller 34 is defined at an appropriate position on the transport path 36.

A sheet cassette 38 is communicated with a lower end of the printer main body 4. The sheet cassette 38 is connected to an upstream end area of the transport path 36. A separation roller pair 40 and a registration roller pair 42 are provided upstream with respect to the nip portion between the drive roller 26 and the secondary transfer roller 34. The separation roller pair 40 and the registration roller pair 42 are arranged in this order from upstream toward downstream along the transport path 36.

A bottom plate 46, a compression coil spring (not shown), and other parts are arranged at respective appropriate positions in the sheet cassette 38. The bottom plate 46 is a sheet setting plate whose one end is pivotally supported about an axis of a rod 44. The compression coil spring is adapted to press the other end of the bottom plate 46 upward. An upper surface on a lead end of the uppermost sheet PA of the sheets stacked on the bottom plate 46 is pressingly contacted with a pickup roller 48 disposed in the printer main body 4.

A fixing device 50 is provided downstream with respect to the nip portion between the drive roller 26 and the secondary transfer roller 34 in the transport path 36. The fixing device 50 has a heater roller 50A and a pressure roller 50B.

A sheet discharge tray 52 is formed at an upper part of the printer main body 4. In FIG. 6, a left end portion of the sheet discharge tray 52 extends substantially vertically downward from an upper surface of the printer main body 4, and a bottom portion of the sheet discharge tray 52 extends from a lower end of the left end portion of the sheet discharge tray 52 rightward upwardly in FIG. 6 to the upper surface of the printer main body 4. A discharge port 54 through which a sheet PA is discharged onto the sheet discharge tray 52 is formed at the left end portion of the sheet discharge tray 52. An upper end of the transport path 36 is bent in such a direction as to extend substantially horizontally toward the discharge port 54 of the sheet discharge tray 52. A discharge roller pair 56 is provided immediately upstream of the discharge port 54.

A printing operation to be executed by the printer 2 having the above arrangement is briefly described referring to FIG. 6. In performing a printing operation, electrostatic latent images are respectively formed in the processing units 6M, 8C, 10Y, and 12BK by allowing the surfaces of the photosensitive drums 14 which are uniformly charged by the respective corresponding chargers 16 to be exposed to laser light emitted from the laser scanning unit LSU. The electrostatic latent images are developed into toner images by the respective corresponding developers 18. The toner images are then transferred to the intermediate transfer belt 30 by the respective corresponding primary transfer rollers 20. At this time, the toner images are successively superimposed one over the other onto the intermediate transfer belt 30 from the toner image formed in the upstream most processing unit 6M in the predetermined order. The superimposed color toner images transferred to the intermediate transfer belt 30 are then transferred onto a sheet PA passing through the nip portion between the drive roller 26 and the secondary transfer roller 34. The super imposed color toner images transferred onto the sheet PA are thermally fixed on the sheet PA while the sheet PA passes through the fixing device 50. After the toner image fixation, the sheet PA is discharged onto the sheet discharge tray 52 by the discharge roller pair 56, with its surface carrying the transferred toner images facing downward.

Next, the cleaning devices 22 provided in the printer 2 are described. Since the cleaning devices 22 provided in the processing units 6M, 8C, 10Y, and 12BK are substantially identical to each other in construction, the cleaning device 22 of the magenta processing unit 6M is described as a representative of the cleaning devices 22.

Figure 2:
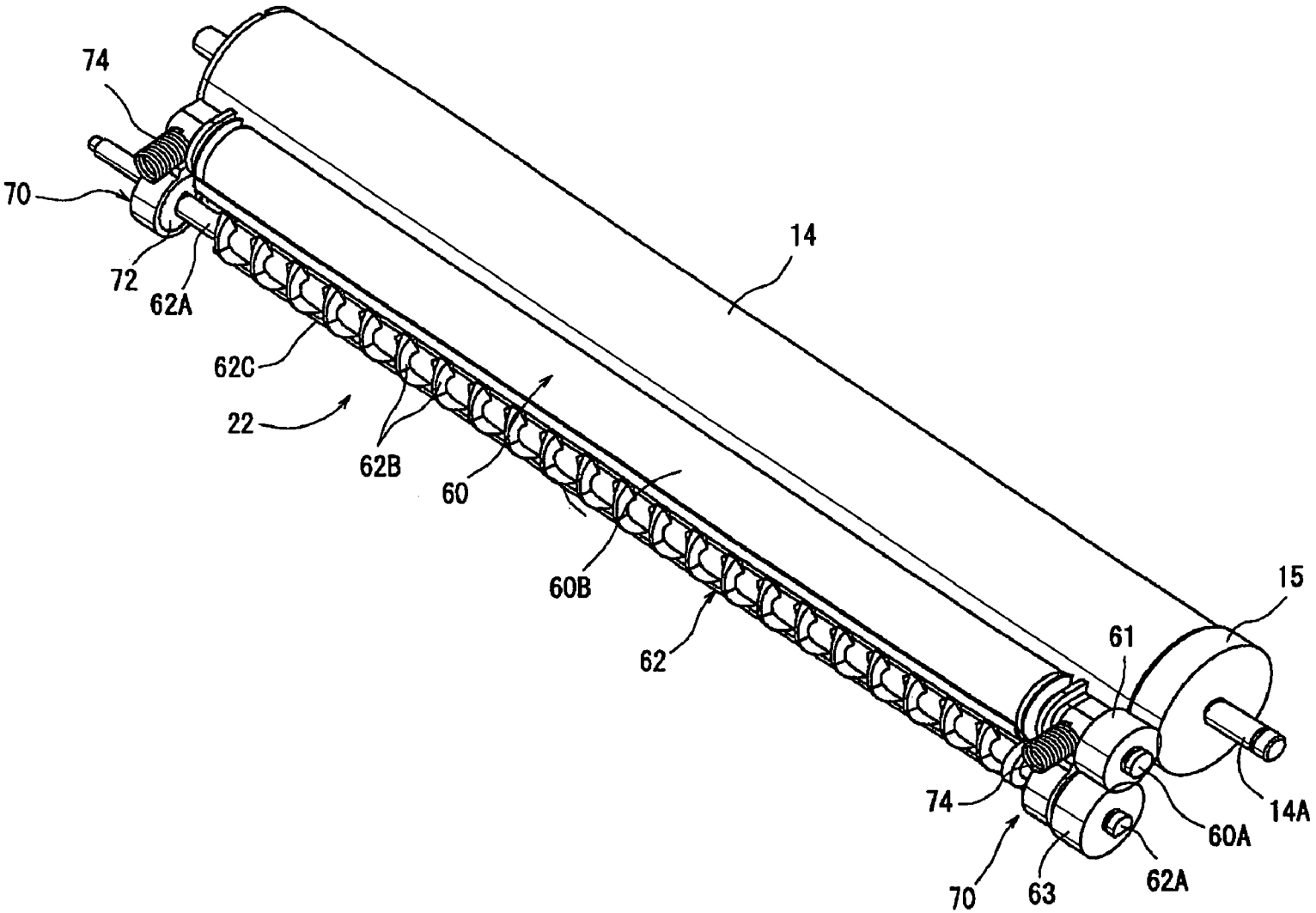
FIG. 2 is a perspective view of the cleaning device shown in FIG. 1, viewed from a different angle.
Figure 3:
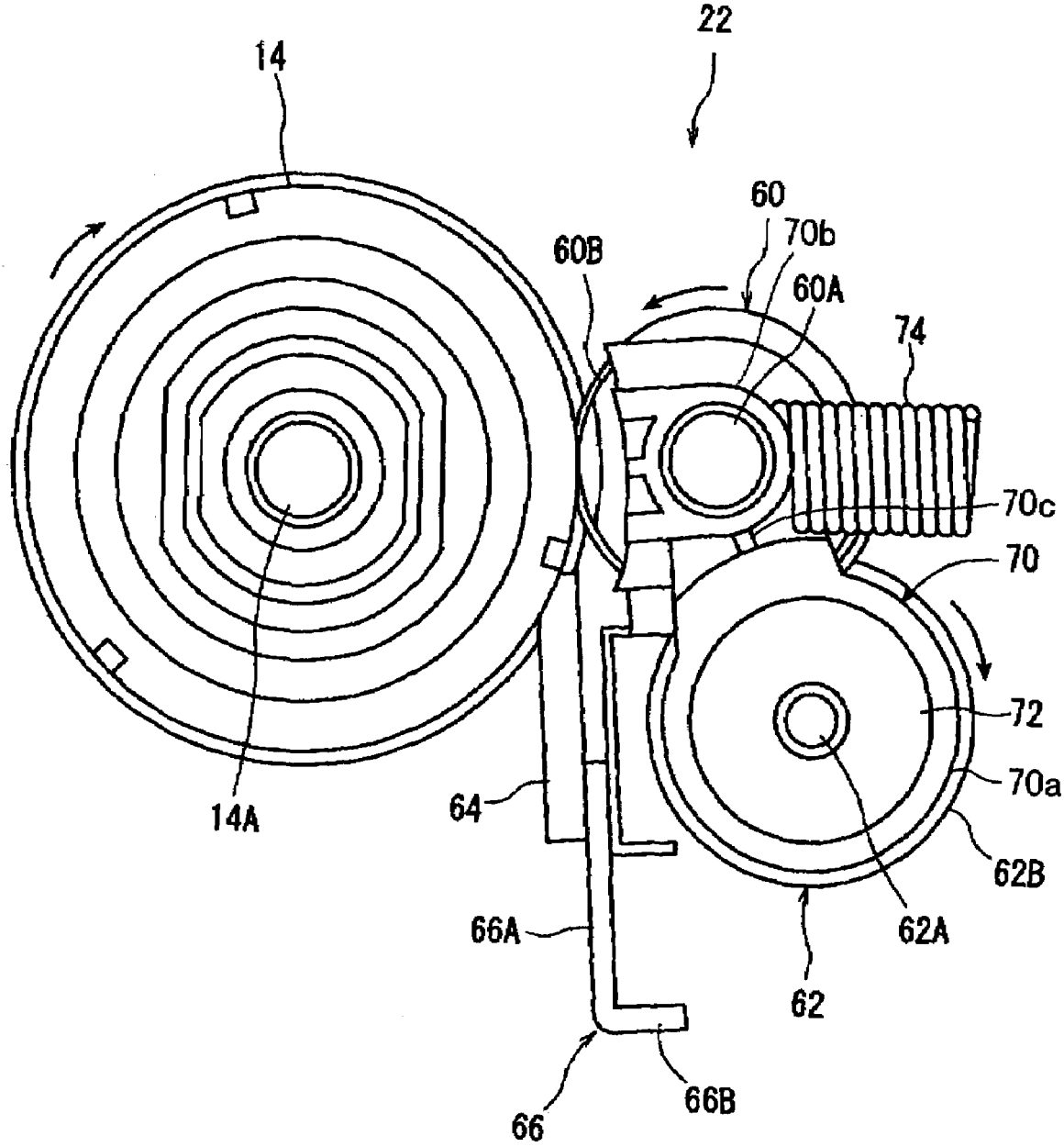
FIG. 3 is a diagram viewed from the direction of the arrow A in FIG. 1.

As shown in FIGS. 1 through 3, the cleaning device 22 includes a cleaning housing 59 (see FIG. 6), a cleaning roller 60, a spiral roller 62, and a cleaning blade 64. The cleaning housing 59 has two side walls disposed away from each other by a certain distance in the axis direction of the photosensitive drum 14.

A sheet metal frame 66 is provided between the side walls of the cleaning housing 59. The frame 66 includes a vertically extending main body 66A, and a flange portion 66B extending substantially horizontally from a lower end of the frame main body 66A. Thus, the frame 66 has a substantially L-shape in cross section. A lower end of the cleaning blade 64 is fixed to an upper end of the main body 66A of the frame 66. An upper end of the cleaning blade 64 is pressingly contacted with the surface of the photosensitive drum 14. The upper end of the cleaning blade 64 and the surface of the photosensitive drum 14 are contacted with each other at a position lower than an imaginary horizontal plane (not shown) passing a center of axis of a rotating shaft 14A of the photosensitive drum 14.

The spiral roller 62 includes a shaft 62A, as a second shaft, which extends in parallel with the axis direction of the photosensitive drum 14, a spiral portion 62B spirally formed on the outer surface of the shaft 62A, and a stirring portion 62C radially outwardly protruding from the shaft 62A. Both ends of the shaft 62A are rotatably supported on the side walls of the cleaning housing 59, respectively. The spiral portion 62B is integrally formed with the shaft 62A. Wing segments of the stirring portion 62C each extends in the axis direction of the shaft 62A between corresponding wing segments of the spiral portion 62B at the same angular position in the circumferential direction of the shaft 62A.

The cleaning roller 60 includes a shaft 60A, as a first shaft, which extends in parallel with the axis direction of the photosensitive drum 14, and a roller member 60B mounted on the shaft 60A. The roller member 60B is made of a foaming synthetic rubber.

Figure 4:
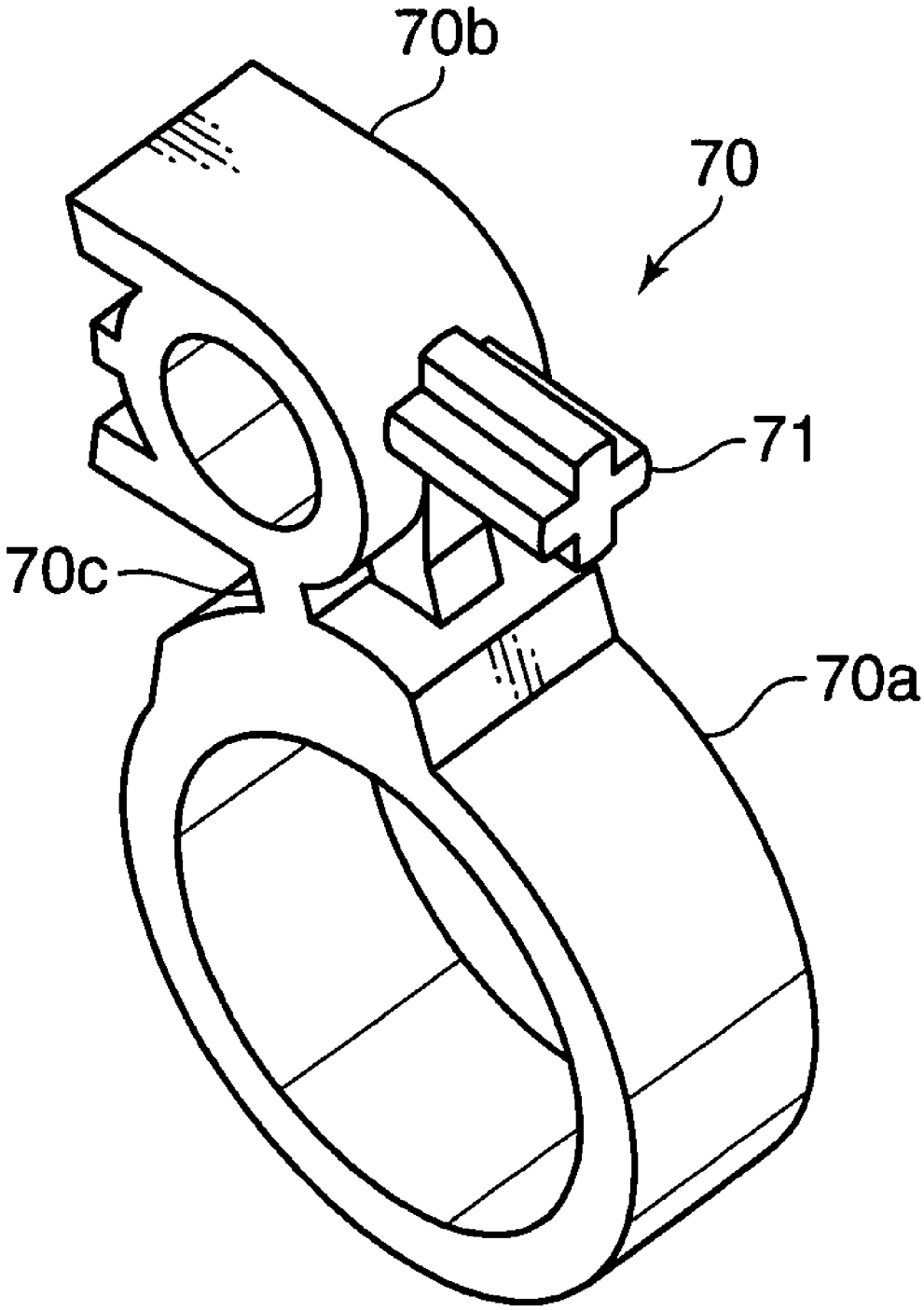
FIG. 4 is a perspective view of an arm member provided in the cleaning device.

Arm members 70 are provided at both ends of the shaft 62A of the spiral roller 62, respectively. As shown in FIG. 4, each of the arm members 70 is integrally formed with a base portion 70*a* interconnected with the spiral roller 62, a distal portion 70*b* interconnected with the cleaning roller 60, and a connecting portion 70*c* for connecting the base portion 70*a* and the distal portion 70*b*. The base portion 70*a* has an annular shape, and is mounted on a bearing 72 fitted on the shaft 62A of the spiral roller 62. The shaft 62A of the spiral roller 62 is supported on the side walls of the cleaning housing 59. With this arrangement, the arm members 70 are allowed to pivot about the base portions 70*a*. In other words, both ends of the shaft 62A are rotatably supported by the arm members 70 via the bearings 72.

The distal portion 70*b* of the arm member 70 has an annular shape, with its diameter smaller than the diameter of the base portion 70*a*. The distal portion 70*b* is mounted on the shaft 60A of the cleaning roller 60. In other words, both ends of the shaft 60A of the cleaning roller 60 are rotatably supported about the distal portions 70*b* of the arm members 70.

The connecting portion 70*c* extends in a direction connecting the center of pivot of the base portion 70*a* and the center of pivot of the distal portion 70*b*. In other words, the connecting portion 70*c* extends in the direction connecting the center of axis of the shaft 60A of the cleaning roller 60 and the center of axis of the shaft 62A of the spiral roller 62. Since the cleaning roller 60 and the spiral roller 62 are interconnected with each other via the arm members 70, the distance between the cleaning roller 60 and the spiral roller 62 in the direction of connecting the center of axis of the shaft 60A and the center of axis of the shaft 62A is set to a predetermined constant value.

The roller member 60B of the cleaning roller 60 is pressed against the surface of the photosensitive drum 14. The roller member 60B is pressed by spring forces of compression coil springs 74 each serving as a pressing member. Specifically, a pair of compression coil springs 74 is provided in the cleaning device 22. Each of the compression coil spring 74 is mounted between the distal portion 70*b* of the corresponding arm member 70, and the corresponding side wall of the cleaning housing 59 to urge the distal portion 70*b* of the arm member 70 toward the photosensitive drum 14. With this arrangement, the roller member 60B is pressed against the photosensitive drum 14. A mounting portion 71 is formed on the distal portion 70*b* of the arm member 70 to mount the corresponding compression coil spring 74. The mounting portion 71 extends in a direction passing the center of pivot of the distal portion 70*b*.

In this embodiment, the pressing contact position of the surface of the photosensitive drum 14 with the roller member 60B of the cleaning roller 60 is located substantially on the imaginary horizontal plane (not shown) passing the center of axis of the rotating shaft 14A of the photosensitive drum 14. The shaft 60A of the cleaning roller 60 and the shaft 62A of the spiral roller 62A extend substantially in parallel with the rotating shaft 14A of the photosensitive drum 14.

A drive gear 15 is mounted on one end of the rotating shaft 14A of the photosensitive drum 14 to be integrally rotated with the photosensitive drum 14. The drive gear 15 is driven by an unillustrated electric motor as a driving source.

The cleaning device 22 has a driving force transmitting mechanism for transmitting the driving force of the drive gear 15 to the cleaning roller 60 and the spiral roller 62. The driving force transmitting mechanism includes a driven gear 61, as a first driven gear, which is mounted on the shaft 60A of the cleaning roller 60; and a driven gear 63, as a second driven gear, which is mounted on the shaft 62A of the spiral roller 62.

The driven gear 61 is mounted on one end of the shaft 60A of the cleaning roller 60 so that the driven gear 61 is integrally rotated with the shaft 60A and the roller member 60B. The driven gear 61 is in mesh with the drive gear 15 of the photosensitive drum 14. With this arrangement, the driven gear 61 is driven in response to receiving a driving force of the drive gear 15.

The driven gear 63 is mounted on one end of the shaft 62A of the spiral roller 62 so that the driven gear 63 is integrally rotated with the shaft 62A and the spiral portion 62B. The driven gear 63 of the spiral roller 62 is in mesh with the driven gear 61 of the cleaning roller 60. With this arrangement, the driven gear 63 is driven in response to receiving a driving force of the driven gear 61.

With the aforementioned drive interlock mechanism, when the photosensitive drum 14 is rotated clockwise in FIG. 3 by the unillustrated electric motor, the cleaning roller 60 is rotated counterclockwise, and the spiral roller 62 is rotated clockwise. As these elements 14, 60, and 62 are rotated as mentioned above, toner residues on the surface of the photosensitive drum 14 are removed by a difference in circumferential speed between the outer surface of the roller member 60B of the cleaning roller 60, and the surface of the photosensitive drum 14. Also, the toner residues on the surface of the photosensitive drum 14 that have not been removed by the aforementioned operation of the roller member 60B are scraped into the cleaning housing 59 by the cleaning blade 64 which is in pressing contact with the surface of the photosensitive drum 14 at a position downstream with respect to the nip portion between the photosensitive drum 14 and the cleaning roller 60. In this way, the toner residues removed from the surface of the photosensitive drum 14 are gathered into the cleaning housing 59 by the spiral roller 62, whereby the toner residues are collected into an unillustrated toner collecting container.

Figure 5:
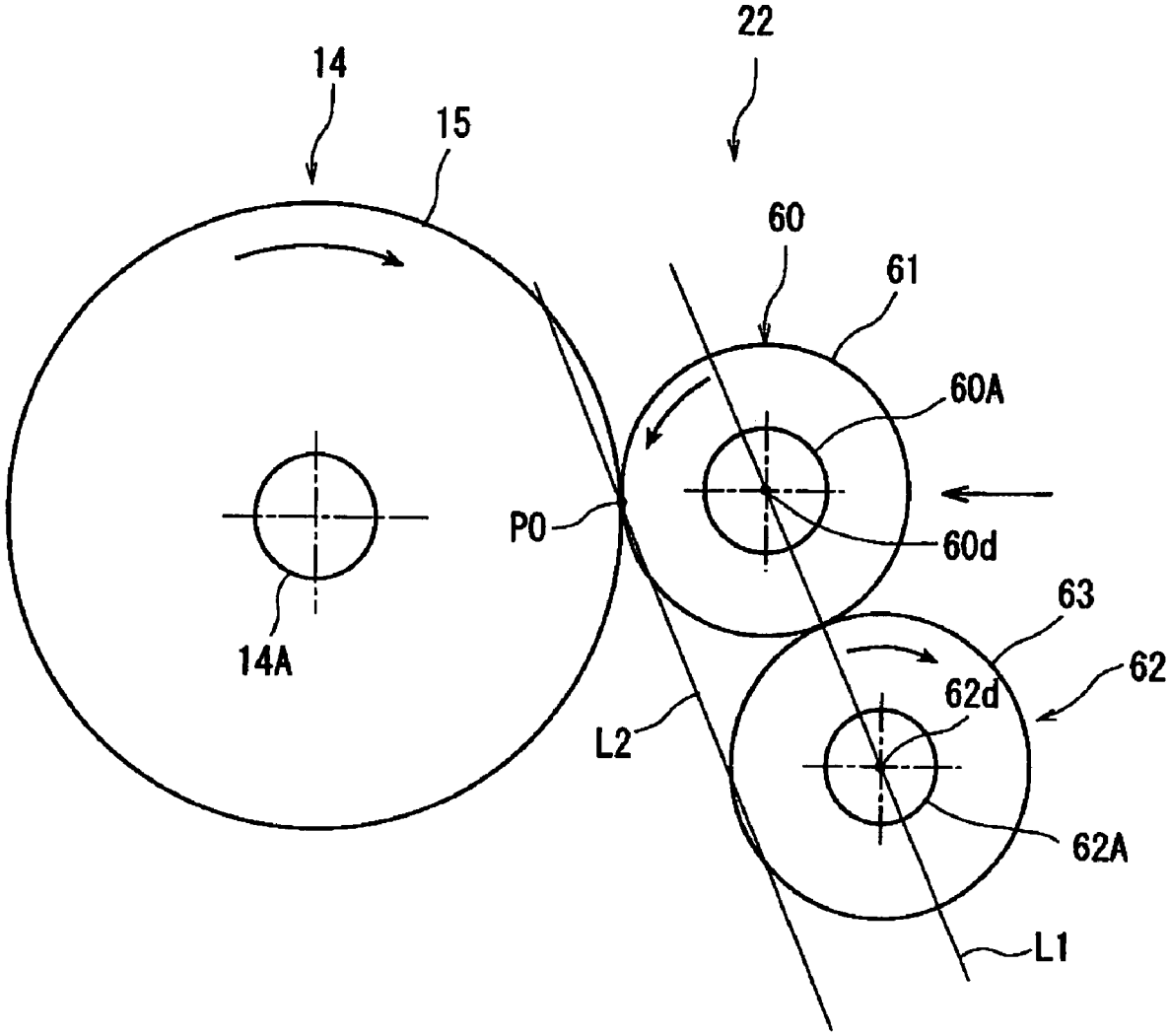
FIG. 5 is a diagram for describing a positional relation between gears of rollers shown in FIG. 3.

Now, a positional relation between the drive gear 15, the driven gear 61, and the driven gear 63 is described referring to FIG. 5. FIG. 5 is a diagram showing the photosensitive drum 14 and its peripheral parts, viewed from the axis direction of the photosensitive drum 14. As shown in FIG. 5, let it be assumed that a line connecting the center of axis 60*d* of the shaft 60A of the cleaning roller 60 and the center of axis 62*d* of the shaft 62A of the spiral roller 62 is defined as L1. Also, let it be assumed that a line of action passing a pitch point PO, in other words, a point of engagement on pitch circles defined by the drive gear 15 of the photosensitive drum 14 and by the driven gear 61 of the cleaning roller 60 is defined as L2. The line of action L2 corresponds to a line of action of a force of the driven gear 61 and the driven gear 63 acting on the pitch point. In other words, the line of action L2 is a straight line extending, passing the pitch point, in a direction substantially orthogonal to a tangential line of the toothed surfaces of the driven gears 61 and 63. The line L1 and the line L2 extend parallel or substantially parallel to each other.

In the above arrangement, in the case where a driving torque of the photosensitive drum 14 is unduly increased, because the roller member 60B of the cleaning roller 60 is degraded with time e.g. deformation or abrasion, the force acting on the cleaning roller 60 is exerted on the shaft 62A of the spiral roller 62. With this arrangement, an influence of the unduly increased driving torque which may adversely affect the pressing force of the cleaning roller 60 to the photosensitive drum 14 can be reduced. As a result, the pressing force of the cleaning roller 60 can be set to a minimally required amount, thereby enabling to suppress image jitter and noise resulting from jitter of the photosensitive drum 14. In FIG. 5, the horizontally extending arrow represents the direction in which the cleaning roller 60 is pressingly contacted against the surface of the photosensitive drum 14 by the compression coil spring pair 74.

The cleaning device 22 includes the arm member pair 70 whose one end portion is pivotally supported by the shaft 62A of the spiral roller 62. The shaft 60A of the cleaning roller 60 is rotatably supported by the arm members 70. In other words, the shaft 62A of the spiral roller 62 and the shaft 60A of the cleaning roller 60 have their movements constrained by the arm members 70. This enables to securely set the distance between the driven gear 61 of the cleaning roller 60, and the driven gear 63 of the spiral roller 62 in the direction of connecting the center of axis of the shaft 60A and the center of axis of the shaft 62A to a predetermined constant value. Also, even if the roller member 60B of the cleaning roller 60 is degraded with time, the aforementioned distance between the driven gears 61 and 63 is securely kept to the predetermined constant value. Accordingly, the point of engagement between the driven gear 61 of the cleaning roller 60 and the driven gear 63 of the spiral roller 62 can be securely set to a certain position, thereby enabling to maintain the engaged state of the driven gears 61 and 63 in a stable manner. Thus, the above arrangement is advantageous in suppressing image jitter and noise resulting from jitter of the photosensitive drum 14.

Figure 7:
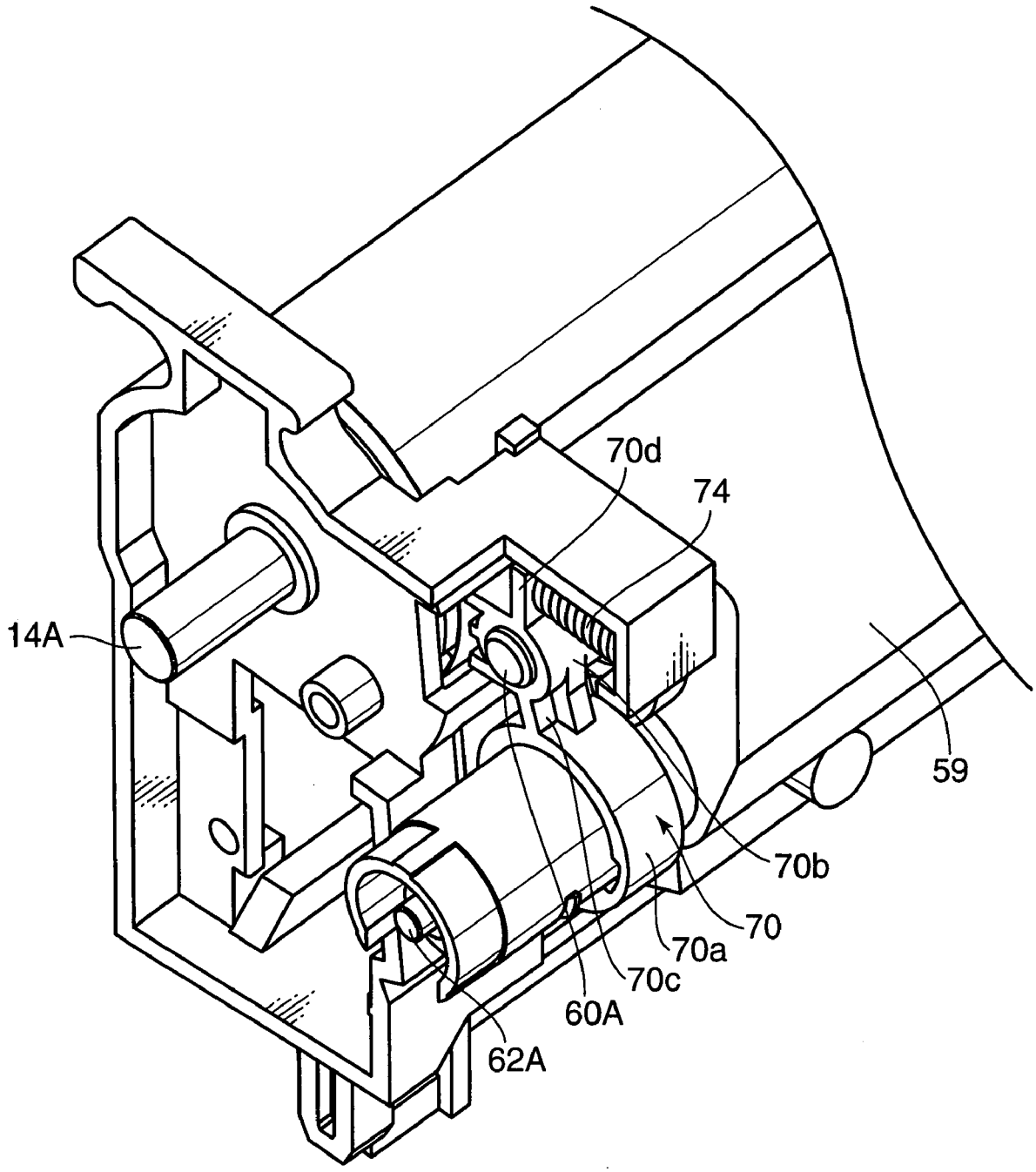
FIG. 7 is a perspective view partly showing a cleaning device as a modification of the embodiment of the invention.

In this embodiment, the compression coil springs 74 are located on the imaginary horizontal plane passing the center of axis of the rotating shaft 14A of the photosensitive drum 14. Alternatively, as shown in FIG. 7, an extension 70*d* extending from the distal portion 70*b* of the arm member 70 may be formed in such a manner that the compression coil spring 74 presses the extension 70*d*. In the modification, the mounting portion 71 for mounting the compression coil spring 74 is provided on the extension 70*d*, and the compression coil spring 74 is arranged above the imaginary horizontal plane passing the center of axis of the rotating shaft 14A of the photosensitive drum 14.

The following is a summary of the embodiment of the invention.

(1) In the embodiment, the first shaft and the second shaft are interlocked with each other by the arm members. In this arrangement, even while a driving force is transmitted between the first shaft and the second shaft by the driving force transmitting mechanism, the distance between the first shaft and the second shaft is kept to a predetermined constant value. This enables to suppress fluctuation in force for driving the photosensitive drum. Also, even if the first shaft is displaced as the cleaning roller is degraded with time, an influence of fluctuation in driving force due to degradation of the cleaning roller with time can be suppressed, because the distance between the first shaft and the second shaft is kept to the constant value because of interlocking of the first shaft and the second shaft with the arm members. This enables to stably transmit the driving force between the first shaft and the second shaft. Thereby, image jitter or noise resulting from jitter of the photosensitive drum can be suppressed.

(2) In the cleaning device of the embodiment, preferably, the photosensitive drum may include a rotating shaft, and a drive gear mounted on the rotating shaft, and the driving force transmitting mechanism may include a first driven gear which is mounted on the first shaft and is in mesh with the drive gear, and a second driven gear which is mounted on the second shaft and is in mesh with the first driven gear.

In the above arrangement, the distance between the center of axis of the first driven gear and the center of axis of the second driven gear is kept to a constant value by the arm members. This enables to suppress a change in engagement between the first driven gear and the second driven gear, and to stably transmit the driving force between the first driven gear and the second driven gear. As a result, a load of the drive gear for driving the first driven gear is stabilized, thereby enabling to stabilize the driving force for rotating the photosensitive drum. Also, even if the first driven gear is displaced due to a change in pressing force of the cleaning roller by the pressing member, the distance between the center of axis of the first driven gear and the center of axis of the second driven gear can be kept to the constant value. This enables to stabilize the driving force for rotating the photosensitive drum even if the pressing force is changed. Thereby, image jitter or noise resulting from jitter of the photosensitive drum can be suppressed.

(3) In the cleaning device, preferably, a line connecting a center of axis of the first shaft and a center of axis of the second shaft may be, as viewed from an axis direction of the photosensitive drum, parallel or substantially parallel to a line of action of a force acting on a pitch point between the drive gear and the first driven gear.

In the above arrangement, the first shaft and the second shaft are aligned in the direction of a force acting from the drive gear to the first driven gear, in other words, the direction of the line of action of the force acting at the pitch point. Thereby, the force acting on the first driven gear can be exerted on the second shaft. With this arrangement, even if the driving torque of the photosensitive drum is unduly increased due to degradation of the cleaning roller with time or a like phenomenon, an influence of the increased driving torque can be suppressed, thereby enabling to suppress fluctuation in pressing force of the cleaning roller against the photosensitive drum. This enables to set the pressing force of the cleaning roller against the surface of the photosensitive drum to a minimally required amount, thereby enabling to suppress image jitter or noise resulting from jitter of the photosensitive drum.

(4) In the cleaning device, preferably, one of the arm member pair may be arranged at one end of the first shaft and the second shaft, and the other of the arm member pair may be arranged at the other end of the first shaft and the second shaft, and the cleaning roller may be disposed between the arm member pair.

In the above arrangement, since both ends of the first shaft are interconnected with the arm members, respectively, and both ends of the second shaft are interconnected with the arm members, respectively, the first shaft and the second shaft can be easily aligned in parallel to each other.

(5) The embodiment is also directed to an image forming apparatus including a photosensitive drum for forming a toner image, and the cleaning device having the above arrangement.

This application is based on Japanese Patent Application No. 2006-250511 filed on Sep. 15, 2006, the contents of which are hereby incorporated by reference.

Although the invention has been appropriately and fully described by way of examples with reference to the accompanying drawings, it is to be understood that various changes and/or modifications will be apparent to those skilled in the art. Therefore, unless otherwise such changes and/or modifications depart from the scope of the present invention hereinafter defined, they should be construed as being included therein.

What is claimed is:

1. A cleaning device for removing toner residues on a surface of a photosensitive drum, the cleaning device comprising:

a first shaft;

a cleaning roller which is operable to come into contact with a surface of a photosensitive drum, and is integrally rotated with the first shaft;

a pressing member for pressing the cleaning roller against the surface of the photosensitive drum;

a second shaft;

a spiral roller which is integrally rotated with the second shaft, and is operative to collect toner residues from the surface of the photosensitive drum;

a driving force transmitting mechanism for transmitting a driving force of the photosensitive drum to the first shaft and the second shaft; and a pair of arm members which are pivotally interlocked with the second shaft, and are pivotally interlocked with the first shaft.

2. The cleaning device according to claim 1, wherein the photosensitive drum includes a rotating shaft, and a drive gear mounted on the rotating shaft, and the driving force transmitting mechanism includes a first driven gear which is mounted on the first shaft and is in mesh with the drive gear, and a second driven gear which is mounted on the second shaft and is in mesh with the first driven gear.

3. The cleaning device according to claim 2, wherein a line connecting a center of axis of the first shaft and a center of axis of the second shaft is, as viewed from an axis direction of the photosensitive drum, parallel or substantially parallel to a line of action of a force acting on a pitch point between the drive gear and the first driven gear.

4. The cleaning device according to claim 1, wherein one of the arm member pair is arranged at one end of the first shaft and the second shaft, and the other of the arm member pair is arranged at the other end of the first shaft and the second shaft, and the cleaning roller is disposed between the arm member pair.

5. An image forming apparatus, comprising:

a photosensitive drum for forming a toner image; and the cleaning device according to claim 1.

* * * * *